US007162050B2

(12) United States Patent
Furuya et al.

(10) Patent No.: US 7,162,050 B2
(45) **Date of Patent: *Jan. 9, 2007**

(54) COMPOUND SOUND GENERATOR

(75) Inventors: Masahito Furuya, Yamanashi-ken (JP); Hironori Kuwabara, Yamanashi-ken (JP)

(73) Assignee: Citizen Electronics Co., Ltd., Yamanashi-ken (JP)

( * ) Notice: Subject to any disclaimer, the term of this patent is extended or adjusted under 35 U.S.C. 154(b) by 296 days.

This patent is subject to a terminal disclaimer.

(21) Appl. No.: 10/677,357

(22) Filed: Oct. 3, 2003

(65) Prior Publication Data

US 2004/0071309 A1 Apr. 15, 2004

(30) Foreign Application Priority Data

Oct. 7, 2002 (JP) ..... 2002-294328

(51) Int. Cl.
*H04R 25/00* (2006.01)

(52) U.S. Cl. ..... 381/351; 381/182; 381/186; 381/345

(58) Field of Classification Search ..... 381/391, 381/182, 345, 349–354, 338, 397, 186, 423, 381/424, 426, 430, 396, 398, 189, 407, 386, 381/400, 401, 162, 163, 87, 89, 335; 181/171, 181/179, 182, 183, 189, 199, 144, 145; 379/433.02, 379/430, 431

See application file for complete search history.

(56) References Cited

U.S. PATENT DOCUMENTS

| | | | | |
|---|---|---|---|---|
| 6,091,828 | A * | 7/2000 | Akino et al. | 381/355 |
| 6,212,284 | B1 * | 4/2001 | Puls | 381/345 |
| 2004/0071303 | A1 * | 4/2004 | Furuya et al. | 381/182 |

FOREIGN PATENT DOCUMENTS

KR 2002004791 1/2002

* cited by examiner

*Primary Examiner*—Huyen Le
(74) *Attorney, Agent, or Firm*—Dennison, Schultz & MacDonald

(57) ABSTRACT

A case is provided for mounting an information equipment and a frame of the compound sound generator is set in the case. A speaker and receiver are provided in the frame. A first back chamber is formed in the speaker and a second back chamber is formed in the receiver. A baffle is formed integrally with the frame so as to separate the first and second back chambers from each other.

3 Claims, 1 Drawing Sheet

COMPOUND SOUND GENERATOR

BACKGROUND OF THE INVENTION

The present invention relates to a compound sound generator for an information equipment such as a portable telephone.

The compound sound generator has a speaker for converting a call signal into a sound and a receiver for converting a sound signal into a sound. The sound emitted from the receiver is heard with user's ear close to the telephone and the sound emitted from the speaker is heard even when the telephone is away. Thus the speaker generates sounds of larger volume than the receiver.

FIG. 2 is a sectional view of a conventional compound sound generator set in a case 20 of an information equipment.

The compound sound generator has a flat circular or ellipse shape and is set in a case 20 having substantially a shape of a box. In the case 20, there is provided an annular frame 1 made of synthetic resin on which are various parts of the sound generator mounted, and a common yoke 2 made of a magnetic material is mounted in the frame 1.

The yoke 2 comprises a flange 2*a* formed on an upper periphery of a cylindrical portion 2*b* having a bottom 2*c*. An annular first magnet 3 for the speaker is secured to the underside of the flange 2*a*, and a second magnet 8 for the receiver having disc shape is secured to the bottom 2*c* of th yoke 2. An annular first top plate 4 made of a magnetic material is secured to the underside of the first magnet 3, and a second top plate 9 having a disc shape is secured to the upper surface of the second magnet 8.

A first diaphragm 6 is secured to the underside of the frame 1, thereby forming a relatively small hack chamber 22*a* between the diaphragm 6 and the yoke 2. A second diaphragms 11 is secured to the upper surface of the frame 1, thereby forming a relatively small back chamber 22*b* between the diaphragm 11 and the yoke 2. A first voice coil 5 and a second voice coil 10 are secured to inside surfaces of the first and second diaphragms 6 and 11, respectively. The first diaphragm 6 and the first voice coil 5 compose a first sound production device as a speaker, and the second diaphragm 11 and the second voice coil 10 compose a second sound production device as a receiver. Protectors 7 and 12 each having a dish shape and made of a thin metal plate are secured to the underside and upper surface of the frame 1 for protecting the diaphragms 6 and 11.

There is formed sound discharge holes 7*a* formed in the protector 7, sound discharge holes 12*a* in the protector 12.

The outer peripheries of the protector 7 and the diaphragm 6 are inserted and press fitted in an annular recess formed in a lower projection 1*a* of the frame 1. The outer peripheries of the protector 12 and the diaphragm 11 are inserted and press fitted in an annular recess formed in an upper projection 1*b* of the frame 1.

The compound sound generator is assembled into the case 20 with other parts. Cushioned annular spacers 21 are disposed between each of the protectors 7 and 12 at outer portions of the sound discharge holes 7*a* and 12*a* and the inner space of the case 20.

The case 20 has a plurality of sound discharge holes 20*a* formed in the bottom thereof and a sound discharge hole 20*b* formed in the upper surface thereof.

Sound produced by the diaphragm 11 is discharged through the sound discharge holes 12*a* and further outside through the sound discharge hole 20*b* as shown by an arrow a. Similarly, sound produced by the diaphragm 6 is discharged through the sound discharge holes 7*a* and further outside through the sound discharge holes 20*a* as shown by an arrow b. Mixing of sounds emitted from the back chambers 22*a* and 22*b* with the sounds emitted through the sound discharge holes 7*a* and 12*a* are prevented. The spacers 21 are provided to enhance the air-tightness, thereby separating the sounds from one another.

In order to allow the vibration of the diaphragms and to improve the acoustic characteristics such as volume and sound quality, the back chambers 22*a* and 22*b* are communicated with atmosphere. Namely, as shown by arrows c and d, air in the back chamber 22*b* flows through openings 1*d* partially formed in the projection 1*b* into the inner space of the case 20. Air in the back chamber 22*a* flows into the inner space of the case 20 through air passages 1*c* formed in the shoulder of the frame 1 as shown by arrows e and f.

In the conventional compound sound generator, the back chambers 22*a* and 22*b* are thus communicated with the entire inner space of the case 20. Therefore, a part of the airflow from one of the back chambers 22*b* and 22*a* may flow into the other back chamber through the openings 1*d* or the passages 1*c* as shown by arrows g and h. Hence, when the diaphragm 6 for the speaker is vibrated, the produced sound causes the air pressure to change, thereby vibrating the diaphragm 11 for the receiver so that sound is also emitted from the receiver. If a large sound is emitted from the receiver with user's ear close to the telephone, the user's ear may be hurt. In another case, telephone conversation may leak out and be heard by others through the receiver.

SUMMARY OF THE INVENTION

An object of the present invention is to provide a compound sound generator which prevents sound leaking and causing vibration of the other diaphragm.

According to the present invention, there is provided a sound generator for an information equipment comprising a case of the equipment, a frame set in the case, a speaker and receiver provided in the frame, the speaker having a first diaphragm and the receiver having a second diaphragm, a first back chamber behind the first diaphragm of the speaker and a second back chamber behind the second diaphragm of the receiver, and a baffle formed integrally with the frame so as to separate the first and second back chambers from each other.

The baffle is provided to surround an outside of the second diaphragm of the receiver, and to form an annular space to communicate with the second back chamber of the receiver.

The first back chamber of the speaker is opened to a space between the outside wall of the baffle and the inside wall of the case.

At least one of the first back chamber of the speaker and the second back chamber of the receiver is opened to the outside of the case at a position different from other openings.

These and other objects and features of the present invention will become more apparent from the following detailed description with reference to the accompanying drawings.

DETAILED DESCRIPTION OF TEE PREFERRED EMBODIMENT

Figure 1:
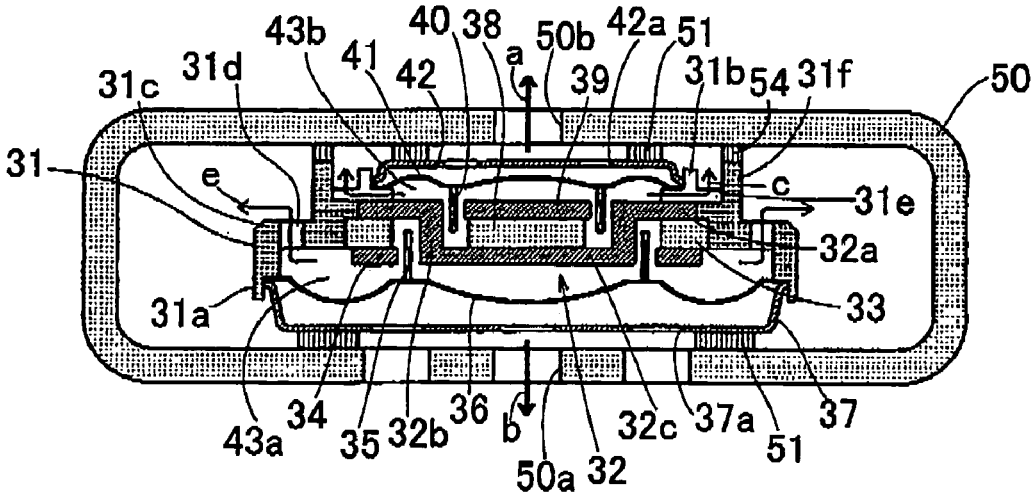
FIG. 1 is a sectional side view showing a compound sound generator of the present invention, set in a case of a portable telephone.
Figure 2:
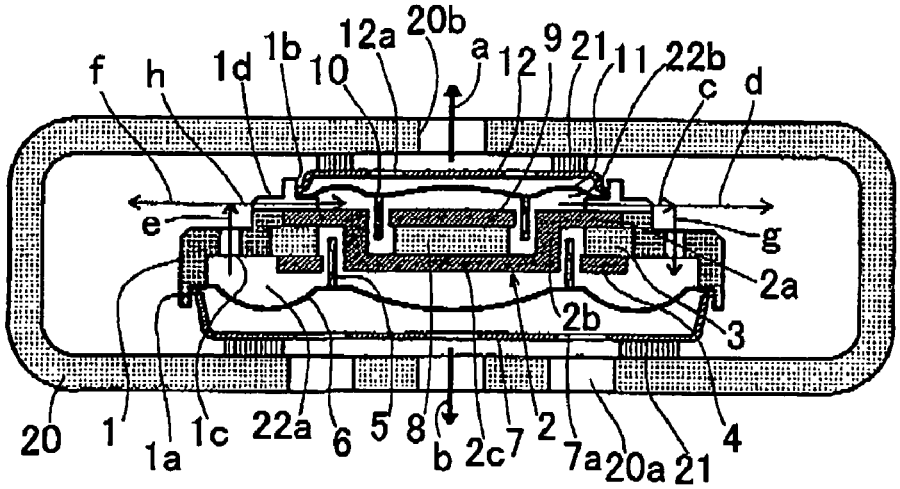
FIG. 2 PRIOR ART
FIG. 2 is a sectional side view showing a conventional compound sound generator set in a case of a portable telephone.

FIG. 1 is a sectional view of a compound sound generator of a first embodiment according to the present invention, set in a case of a portable telephone.

The compound sound generator of the present invention is set in an ellipse shaped case 50. In the case 50, there is provided a frame 31 made of synthetic resin, on which various parts of the sound generator are mounted, and a common yoke 32 made of a magnetic material is mounted in the frame 31.

The yoke 32 comprises a flange 32*a* formed on an upper periphery of a cylindrical portion 32*b* having a bottom 32*c*. An annular first magnet 33 is secured to the underside of the flange 32*a* with an adhesive, and a second magnet 38 having disc shape is secured to the bottom 32*c* of the yoke 32. An annular first top plate 34 made of a magnetic material is secured to the underside of the first magnet 33, and a second top plate 39 having a disc shape is secured to the upper surface of the second magnet 38.

A first diaphragm 36 is secured to the underside of the frame 31, thereby to form a back chamber 43*a* between the diaphragm 36 and the yoke 32. A second diaphragm 41 is secured to the upper surface of the frame 31, thereby to form a back chamber 43*b* between the diaphragm 41 and the yoke 32. The first diaphragm has a larger size approximate to the protector 37, and the second diaphragm has a smaller size approximate to the protector 42, A first voice coil 35 and a second voice coil 40 are secured to inside surfaces of the first and second diaphragms 36 and 41, respectively. The first diaphragm 36 and the first voice coil 35 compose a first sound production device as a speaker, and the second diaphragm 41 and the second voice coil 40 compose a second sound production device as a receiver. First and second protectors 37 and 42, each having a dish shape and made of a thin metal plate, are secured to the underside and upper surface of the frame 31 for protecting the diaphragms 36 and 41.

The first protector 37 has a sound discharge holes 37*a* so as to discharge sounds produced by the first diaphragm 36 in the downward direction. The second protector 42 has sound discharge holes 42*a* so as to discharge sounds produced by the second diaphragm 41 in the upward direction.

The frame 31 has a lower projection 31*a* and an upper projection 31*b*. In the lower projection 31*a*, an annular recess is formed so that the outer peripheries of the protector 37 and the diaphragm 36 are inserted and press fitted therein. In the upper projection 31*b*, an annular recess is formed so that the outer peripheries of the protector 42 and the diaphragm 41 are inserted and press fitted therein. In a shoulder 31*c* of the frame 31, an air passage 31*d* is formed. A pair of opening 31*e* are formed in the lower portion of the upper projection 31*b*.

In accordance with the present invention, the frame 31 further has an upward extending annular baffle 31*f* at the outer aide of the upper projection 31*a*, so as to surround the diaphragm 41.

The compound sound generator is assembled into the case 50 with other parts. Annular spacers 51 are disposed between each of the protectors 37, 42 and the inner surface of the case 50. An annular spacer 54 is interposed between the upper end of the baffle 31*f* and the inner surface of the case 50.

The case 50 has a plurality of sound discharge holes 50*a* formed in the bottom thereof at a portion inside the spacers 51 and a sound discharge hole 50*b* formed in the upper surface thereof.

Sounds produced by the diaphragm 41 are discharged through the sound discharge holes 42*a* of the protector 42 and further outside of the case 50 through the sound discharge hole 50*b* as shown by the arrow a. Similarly, sounds produced by the diaphragm 36 are discharged through the sound discharge holes 37*a* of the protector 37 and further outside the case through sound discharge holes 50*a* as shown by the arrow b.

As shown by the arrow c, air in the back chamber 43*b* flows through the openings 31*e* formed in the projection 31*b* into an annular space defined by the baffle 31*f*, projection 31*b* and spacers 51 and 54. Therefore, it can be said that, by adding the volume of the annular space, the volume of the back chamber 43*b* is virtually increased. Since the outer circumference of the baffle 31*f* can be substantially the same as that of the first diaphragm 36 in maximum, and the outer circumference of the second diaphragm 41 is smaller than that of the first diaphragm 36, the annular space between the baffle 31*f* and the outer periphery of the diaphragm 41 has a large volume. Thus the rear resistance of the vibration of the diaphragm 41 and hence the acoustic impedance are reduced so that the acoustic characteristics are improved.

Air in the back chamber 43*a* flows into the inner space of the case 50 through air passages 31*d* formed in the shoulder 31*c* of the frame 31 as shown by the arrow e. The inner space of the case 50 is formed at the outer side of the annular space inside the baffle 31*f* and is not communicated with the back chamber 43*b*. Namely, the back chambers 43*a* and 43*b* are not communicated with each other so that the air in one of the chambers is prevented from entering the other chamber through the space in the case 50.

In the conventional compound sound generator, the back chamber 22*b* is communicated with the inner space of the case so that the virtual volume of the chamber is large. Although in the present invention, the virtual volume of the back chamber 43*b* is much smaller, sufficient acoustic characteristics is maintained. Meanwhile, the advantage that the back chambers 43*a* and 43*b* are effectively separated is obtained.

Thus, in the present invention, the sounds from the speaker are emitted only from the sound discharge holes 50*a* and the sounds from the receiver are emitted only from the sound discharge hole 50*b*. Hence the problems of injury to the ear and leaking of conversation do not occur.

The present invention is not limited to the embodiment described above. For example, the outer circumference of the baffle 31*f* may be larger than that of the first diaphragm 36. The annular space between the baffle 31*f* and the protector 42 may be communicated with atmosphere through an exclusively formed sound discharge hole, so that the acoustic impedance of the vibration of the diaphragm 41 is reduced, thereby improving the acoustic characteristics. The exclusive sound discharge hole is preferably formed at a position away from the sound discharge hole 50*b* of the receiver or formed in another wall such as the side wall of the case.

Alternatively, the back chamber of the speaker may be communicated with the atmosphere. Various modifications of structure f the baffle and air passage and acoustic separating method and the material thereof are further possible.

The present invention provides a compound sound generator where the back chambers of each of the speaker and the receiver are effectively separated from each other by a simple and inexpensive means of providing a baffle. Accordingly, injury to the ear and leaking of conversation are prevented.

In addition, by communicating the back chamber of the receiver with the annular space surrounding the chamber, and/or by communicating the back chamber of the speaker with the inner space of the case outside the annular space, the volume of the back chamber of the receiver can be virtually increased so that the acoustic characteristics are not impaired. Moreover, when one of the back chambers is communicated with atmosphere, the volume thereof can further be increased, thereby reducing the acoustic impedance and hence improving the acoustic characteristics.

While the invention has been described in conjunction with preferred specific embodiment thereof, it will be understood that this description is intended to illustrate and not limit the scope of the invention, which is defined by the following claims.

What is claimed is:

1. A compound sound generator for an information equipment comprising:

a case of the equipment, the case having an inner surface;

a frame set in the case;

a speaker and receiver provided in the frame, the speaker having a first diaphragm and the receiver having a second diaphragm;

a first protector and a second protector, each having sound discharge holes, secured to the frame for protecting the first diaphragm and the second diaphragm, respectively;

a first back chamber behind the first diaphragm of the speaker and a second back chamber behind the second diaphragm of the receiver;

annular spacers provided between the inner surface of the case and an outer surface of the first protector and between the inner surface of the case and an outer surface of the second protector so as to surround the sound discharge holes of both protectors;

openings provided in the frame for the first back chamber and the second back chamber to communicate with the inside space of the case so as to discharge sounds generated in the first and the second back chambers into the inside space of the case;

an annular baffle formed between the inner surface of the case an outer surface of the frame so as to divide the space in the case into a first space for the speaker and a second space for the receiver, thereby preventing the sound from one of the back chambers from mixing with the sound from the other one of back chambers.

2. The compound sound generator according to claim 1 wherein the baffle is provided to surround an outside of the sound diaphragm of the receiver, and to form an annular space to communicate with the second back chamber of the receiver.

3. The compound sound generator according to claim 1, wherein the annular baffle is formed integrally with the frame.

* * * * *

UNITED STATES PATENT AND TRADEMARK OFFICE

CERTIFICATE OF CORRECTION

PATENT NO. : 7,162,050 B2
APPLICATION NO. : 10/677357
DATED : January 9, 2007
INVENTOR(S) : Masahito Furuya It is certified that error appears in the above-identified patent and that said Letters Patent is hereby corrected as shown below:

In claim 1, column 6, line 19, -- and -- should be inserted between “case” and “an”.

Signed and Sealed this

Sixth Day of May, 2008

JON W. DUDAS
*Director of the United States Patent and Trademark Office*